United States Patent [19]

Morrell, Jr.

[11] Patent Number: 4,467,952

[45] Date of Patent: Aug. 28, 1984

[54] LATCH ASSEMBLY FOR THE FRONT GATE OF THE GUIDE BODY OF AN INDUSTRIAL FASTENER DRIVING TOOL

[75] Inventor: Robert F. Morrell, Jr., Cincinnati, Ohio

[73] Assignee: Senco Products, Inc., Cincinnati, Ohio

[21] Appl. No.: 455,054

[22] Filed: Jan. 3, 1983

[51] Int. Cl.[3] ..... B25C 1/04

[52] U.S. Cl. ..... 227/123; 227/120

[58] Field of Search ..... 227/120, 123, 130

[56] References Cited

U.S. PATENT DOCUMENTS

| | | | |
|---|---|---|---|
| 2,775,764 | 1/1957 | Maynard | 227/123 |
| 2,857,596 | 10/1958 | Allen et al. | 227/123 |
| 2,905,942 | 9/1959 | Grey, Jr. et al. | 227/123 |
| 3,067,724 | 12/1962 | Jenny et al. | 227/123 X |
| 3,273,777 | 9/1966 | Juiles et al. | 227/123 |
| 3,853,257 | 12/1974 | Perkins | 227/123 |
| 3,905,535 | 9/1975 | Novak et al. | 227/120 |
| 4,139,137 | 2/1979 | Gupta | 227/123 |

*Primary Examiner*—Paul A. Bell
*Attorney, Agent, or Firm*—Frost & Jacobs

[57] ABSTRACT

A latch assembly to lock in closed position the front gate of the guide body of an industrial fastener driving tool of the type wherein the guide body and the front gate (in closed position) define a part of a drive track for the tool driver and fasteners. The gate has a first free end and a second end pivotally affixed by a pivot pin to the guide body and is swingable between a closed position against the guide body and an open position. The latch comprises a leaf spring overlying the gate and having a first free end and a second end pivotally affixed to the guide by the same pivot pin as the gate. The leaf spring has first and second angularly related portions so as to bow outwardly of the gate. A latch pin is mounted transversely on the leaf spring along the juncture of its first and second portions with the ends of the latch pin extending beyond the leaf spring. A U-shaped latch lever is provided having a base portion to be manually grasped and hook-shaped legs terminating in free ends pivotally affixed to the guide body to either side of the gate and the leaf spring. The latch lever is pivotable between an open position and a closed position wherein the legs thereof engage the latch pin ends with an over-center action, urging the leaf spring against the gate and locking the gate in its closed position.

8 Claims, 9 Drawing Figures

LATCH ASSEMBLY FOR THE FRONT GATE OF THE GUIDE BODY OF AN INDUSTRIAL FASTENER DRIVING TOOL

TECHNICAL FIELD

The invention relates to a latch assembly for the front gate of the guide body of an industrial fastener driving tool, and more particularly to such a latch assembly which is characterized by an over-center action, easy manual opening and closing, and no close tolerance manufacturing requirements.

BACKGROUND ART

The principles of the present invention are applicable to industrial fastener driving tools of the type utilized to drive staples, nails and other fastening means. While not intended to be so limited, the present invention will, for purposes of an exemplary showing, be described in its application to an industrial staple driving tool.

In the manufacture of industrial staplers and nailers, it is common practice to provide a guide body and an associated latchable gate at the lower front nose portion of the tool. The guide body and gate (when the gate is in closed position) define a drive track for the tool driver and for the fastener elements. The purpose of the gate is to provide access to the drive track in the event that a fastener becomes jammed in the drive track.

Prior art workers have devised numerous types of gate and gate latch assemblies. Examples of such structures are taught in U.S. Pat. Nos. 3,273,777; 3,905,535; and 4,139,137.

The prior art gate and latch assemblies, of which the above mentioned patents are exemplary only, have been characterized by certain deficiencies. Force is applied to the gate latch each time a fastener is driven, because the gate is a part of the drive track. This has frequently cuased excessive wear on the latch mechanism. In many prior art structures, the forces required to latch and unlatch the gate are high. When the tool is jammed, as much as a 1.5 ton load may be applied to the gate. The forces required to unlatch the gate frequently becomes so high, when a fastener is jammed in the drive track, that a hammer or other tool is required to unlatch the front gate. This can result in additional damage to the latch mechanism and the tool itself.

In copending application Ser. No. 06/360,180, filed Mar. 22, 1982, in the name of William T. Jobe, and entitled FRONT GATE AND LATCH ASSEMBLY FOR THE GUIDE BODY OF AN INDUSTRIAL FASTENER DRIVING TOOL, there is taught a latch assembly which overcomes many of the above noted deficiencies of earlier latch assemblies. The latch assembly of this copending application, however, is made up of a number of parts, some of which require machining.

The structure of the present invention provides a positive latch which can be easily opened manually, even when a fastener is jammed in the drive track. Latching of the gate is positive by virtue of the over-center action of the latch. Furthermore, the latch assembly of the present invention does not require close tolerance manufacturing.

DISCLOSURE OF THE INVENTION

According to the invention there is provided a latch assembly for locking in closed position the front gate of the guide body of an industrial fastener driving tool of the type wherein the guide body and the front gate (in closed position) define a part of a drive track for the tool driver and fasteners. The gate has a first free end and a second end pivotally affixed to the guide body by a pivot pin. The gate is swingable between a closed position against the guide body and an open position giving access to the drive track.

The latch assembly comprises a leaf spring overlying the gate. The leaf spring has a first free end and a second end pivotally affixed to the guide body by the same pivot pin as the gate. The leaf spring has first and second angularly related positions so as to bow outwardly from the gate. A latch pin is mounted transversely on the leaf spring along the juncture of its first and second portions. The ends of the latch pin extend beyond the longitudinal edges of the leaf spring and the gate.

A U-shaped latch lever is provided. The latch lever has a base portion, adapted to be manually grasped, and hook-shaped legs terminating in free ends. The free ends of the legs are pivotally affixed to the guide body and are located to either side of the gate and the leaf spring. The latch lever is pivotable between an open position extending forwardly and substantially perpendicular to the guide body and a closed position extending substantially along the guide body. When the gate and the leaf spring are pivoted to their closed positions and the latch lever is thereafter pivoted toward its closed position, the free ends of the latch pin are engaged by cam surfaces on the latch lever legs with an over-center action, urging the free end of the leaf spring against the free end of the gate to positively lock the gate in its closed position.

BRIEF DESCRIPTION OF THE DRAWINGS

FIG. 3 is a perspective view of the guide body, the gate and the latch assembly of the present invention.

DETAILED DESCRIPTION OF THE INVENTION

Figure 1:
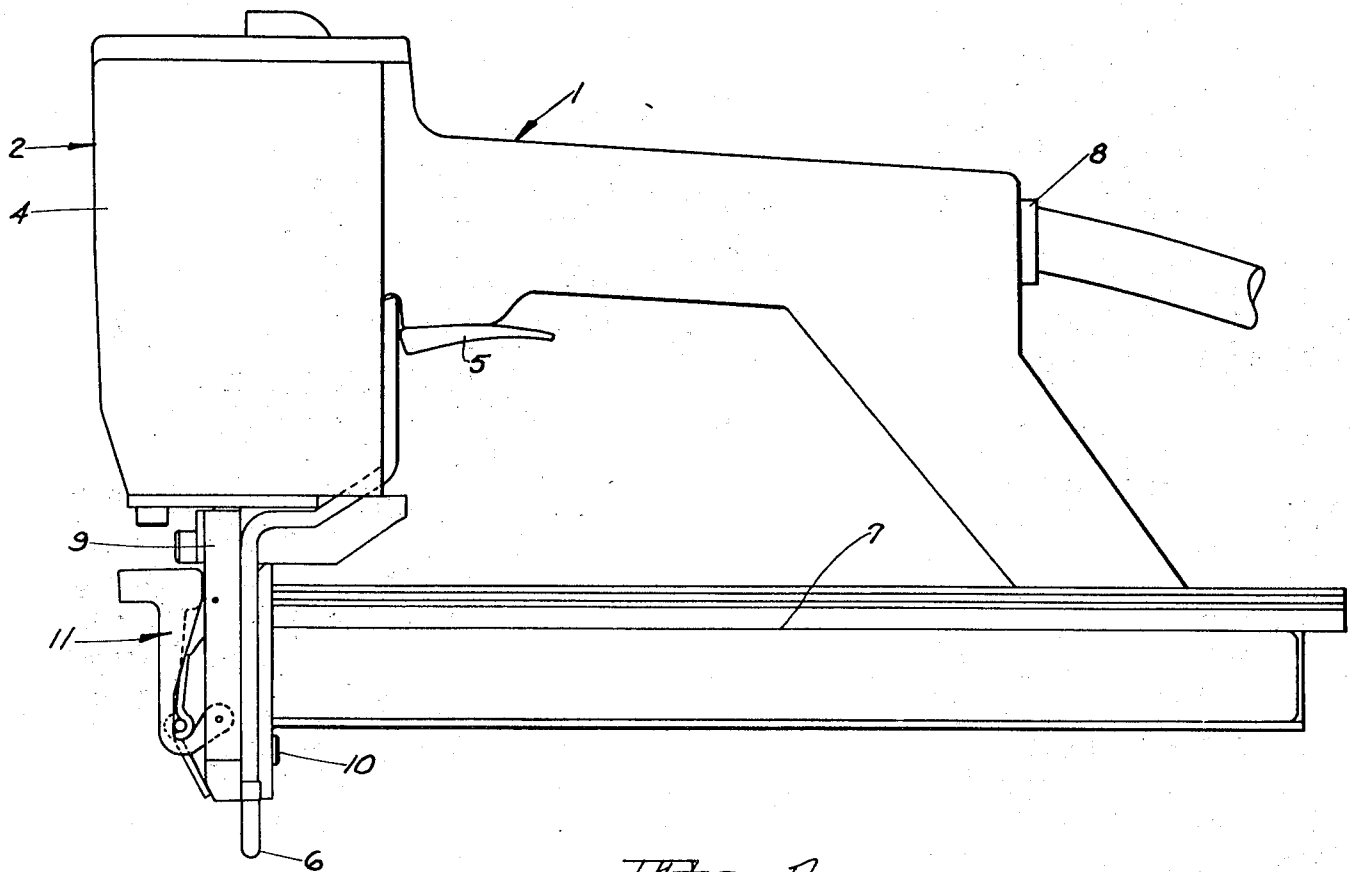
FIG. 1 is a side elevational view of an exemplary fastening tool to which the latch assembly of the present invention has been applied.
Figure 2:
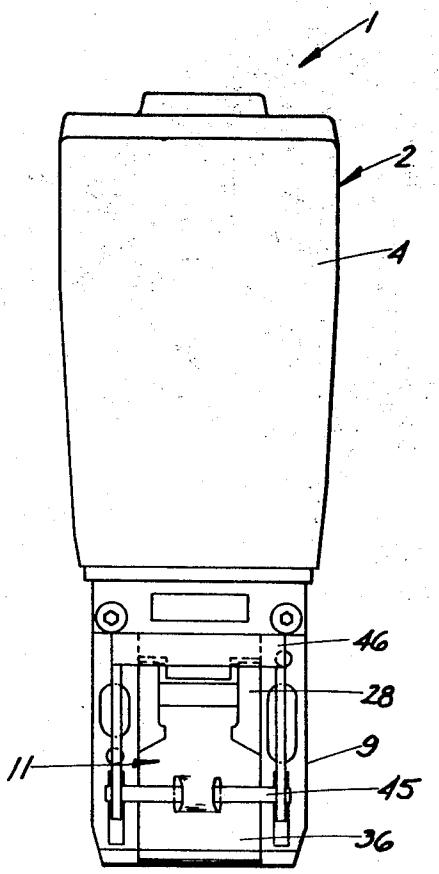
FIG. 2 is a front elevational view of the tool of FIG. 1.

Turning first to FIGS. 1 and 2, there is illustrated an exemplary industrial fastener driving tool provided with the latch assembly of the present invention. The fastener driving tool is generally indicated at 1. While the teachings of the present invention are equally applicable to electromechanically operated tools, well known in the art, the tool 1 is illustrated as being of the pneumatic type.

The tool 1 comprises a housing, generally indicated at 2, having a handle portion 3 and a forward portion 4 which houses the main valve, the cylinder, and the piston and driver assembly (not shown), all of which are well known in the art. At the juncture of the housing portions 3 and 4, a remote valve assembly (not shown) is located within the housing 2. The remote valve assembly is actuated by a trigger 5 and a workpiece responsive trip 6 to actuate the main valve and cause tool 1 to drive a staple. The tool 1 has a magazine portion 7 adapted to contain and advance a row of staples. The tool 1 also has a fitting 8 by which it can be connected to a source of air under pressure.

At the lower forward end or nose portion of tool 1, a guide body 9 is affixed to the forward end of magazine portion 7 and beneath the main cylinder containing the piston and driver assembly (not shown) located within body portion 4. Guide body 9 is mounted by means of threaded fasteners, one of which is shown at 10 in FIG. 1.

As will be described in detail hereinafter, guide body 9 has an opening closable by a gate, which gate is lockable in the closed position by the latch assembly of the present invention, generally indicated at 11 in FIGS. 1 and 2.

Figure 4:
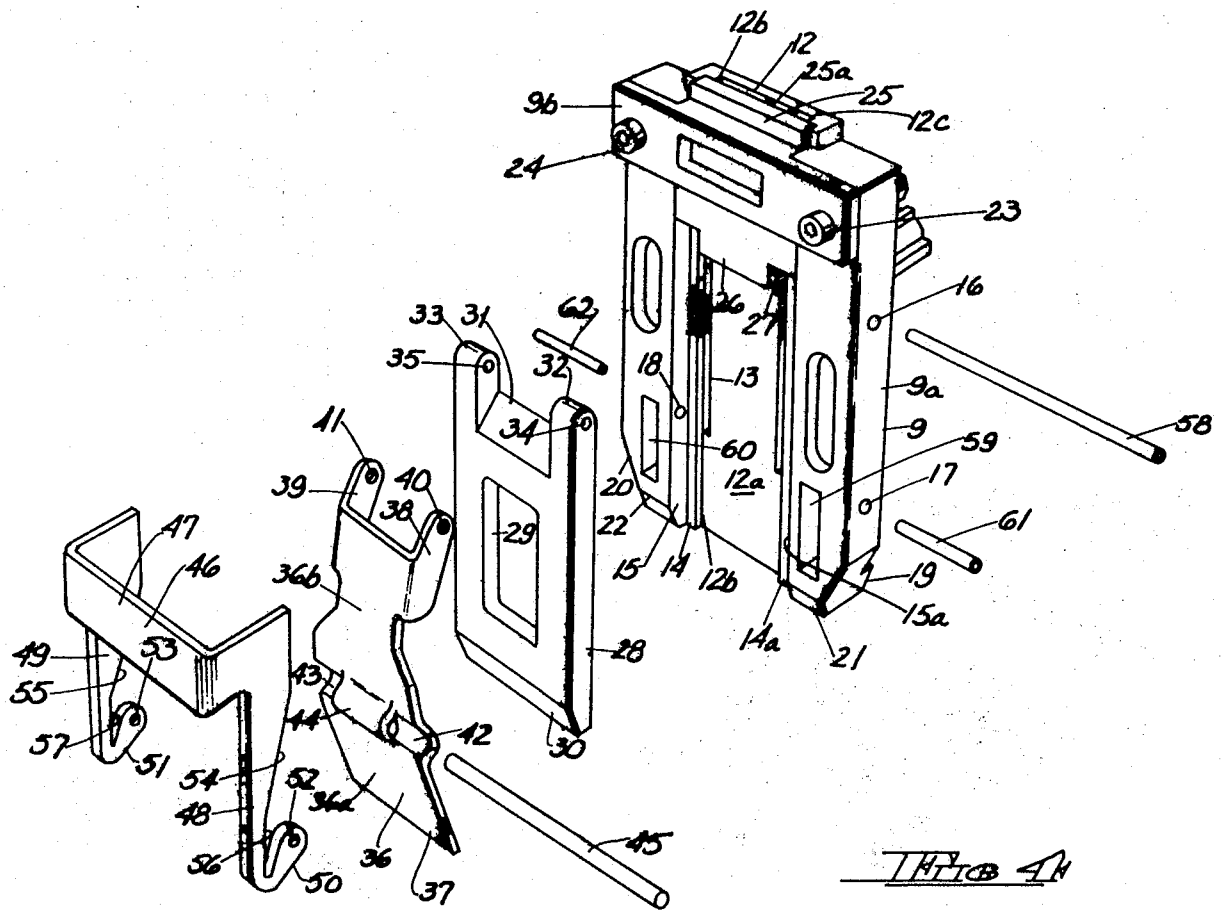
FIG. 4 is an exploded perspective view of the guide body, the front gate and the latch assembly.
Figure 5:
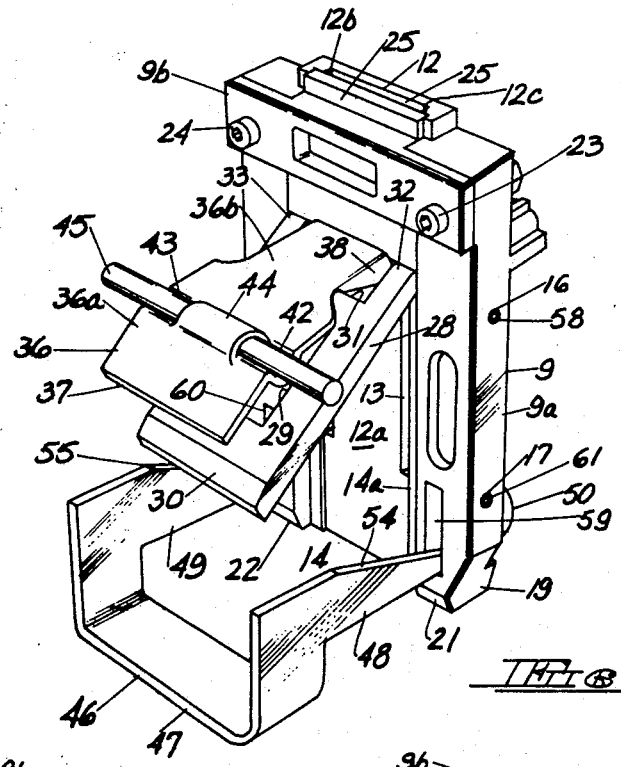

Reference is now made to FIG. 4. The guide body 9 comprises a main body portion 9*a* and a supplementary body portion 9*b*. The main body portion 9*a* is substantially rectangular with a central, longitudinal channel 12 formed therein. Channel 12 is formed by a rear wall 12*a* and side walls 12*b* and 12*c*. The walls 12*a*, 12*b* and 12*c* constitute the rear and side walls, respectively, of the drive track for the tool driver and staples (not shown). The rear wall 12*a* has a U-shaped perforation 13 therethrough, so sized as to permit the passage of the forwardmost staple in the magazine therethrough and into the drive track. The side walls 12*b* and 12*c* approximate in width the thickness of a staple.

The side walls 12*b* and 12*c* terminate in shoulders 14 and 14*a* which serve as seats for the gate to be described hereinafter. The shoulders 14 and 14*a*, themselves, terminate in side walls 15 and 15*a* which approximate in width the thickness of the gate.

The main body portion 9*a* has a first pair of transverse, coaxial perforations, one of which is shown at 16. Main body portion 9*a* also has a second pair of coaxial transverse perforations, shown at 17 and 18. The purpose of these pairs of coaxial perforations will be apparent hereinafter. The side edges of the main body portion 9*a* are beveled inwardly as at 19 and 20. Similarly, the lower front edges are beveled inwardly as at 21 and 22.

The supplemental body portion 9*b* extends across the upper part of main body portion 9*a* and is affixed thereto by machine screws 23 and 24. The supplemental body portion 9*b* has an inwardly extending enlarged portion 25 which extends between the walls 15 and 15*a* and abuts the shoulders 14 and 14*a* of main body portion 9*a*. The rear surface 25*a* of the enlarged portion 25 constitutes a part of the front wall of the drive track. The enlarged portion 25 has a downwardly depending lug-like portion 26 with a transverse perforation 27 therethrough. The perforation 27 is coaxial with the first pair of perforations of main body portion 9*a* (one of which is shown at 16).

The gate is shown in FIG. 4 at 28. The gate 28 comprises a substantially rectangular member having a central opening 29. The lower forward edge of gate 28 is beveled inwardly as at 30. Edge 30 substantially matches edges 21 and 22 on main body portion 9*a* of guide body 9.

At its upper end, the gate 28 is provided with a notch 31. The notch 31 results in the formation of bifurcations 32 and 33. The bifurcations 32 and 33 contain transverse, coaxial perforations 34 and 35, respectively.

The leaf spring of the latch assembly is shown at 36 in FIG. 4. Leaf spring 36 has a first substantially planar body portion 36*a* and a second substantially planar body portion 36*b*. Body portions 36*a* and 36*b* are angularly related, as can be clearly seen in FIGS. 6 through 9. Leaf spring portion 36*a* terminates in a free end 37. The leaf spring portion 36*b* terminates in rearwardly bent flanges 38 and 39 constituting parallel spaced bifurcations and having coaxial perforations 40 and 41, respectively, therein.

At the juncture of leaf spring portions 36*a* and 36*b* a pair of arcuate depressions 42 and 43 are formed, separated by an intermediate arcuate depression 44, curved in the opposite direction. The arcuate depressions 42 through 44 are adapted to receive an elongated, cylindrical latch pin 45 with a friction fit. When latch pin 45 is mounted on leaf spring 36, the free ends of latch pin 45 extend laterally beyond the side edges of the leaf spring 36 and the side edges of gate 28, as is clearly shown in FIGS. 2, 3 and 5.

To complete the latch assembly, a latch lever is shown at 46 in FIG. 4. Latch lever 46 is basically U-shaped having a base portion 47, adapted to be grasped by the hand of an operator, and a pair of substantially identical legs 48 and 49. The legs 48 and 49 terminate in hook-shaped portions 50 and 51, respectively. The hook-shaped portions 50 and 51 are provided with coaxial perforations 52 and 53. The legs 48 and 49 have first cam surfaces 54 and 55 respectively, and second cam surfaces 56 and 57, respectively. The purposes of these cam surfaces will be apparent hereinafter.

It will be evident from FIG. 4 that the primary latch assembly pieces, i.e., the leaf spring 36 and the latch lever 46 can easily be made by means of a punch press or brake press, and require no precision machining, no welding or the like.

Figure 5:
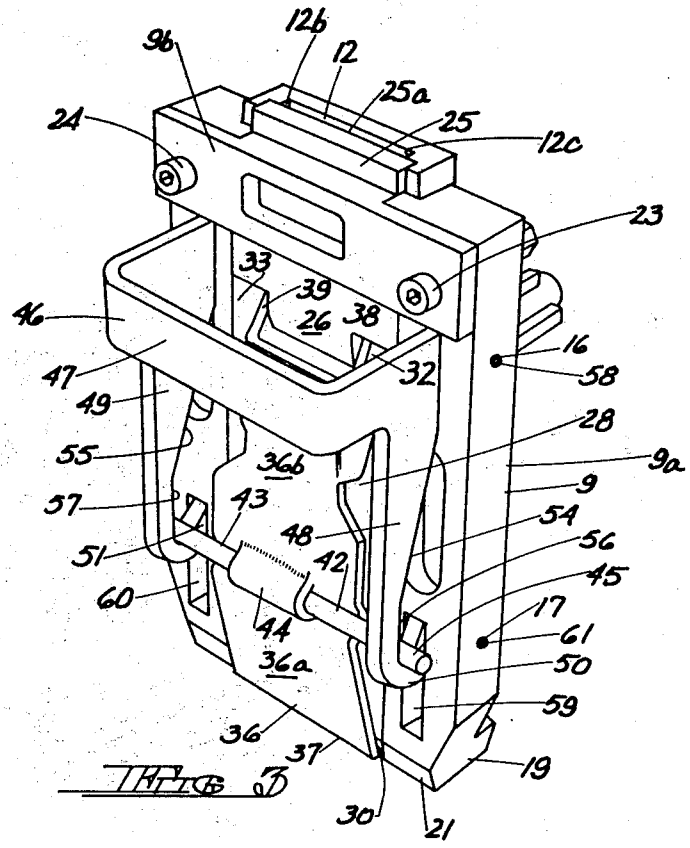
FIG. 5 is a perspective view, similar to FIG. 3, but illustrating the gate and the latch assembly in their open positions.

Reference is again made to FIG. 4, in conjunction with FIGS. 3 and 5. Like parts have been given like index numerals in all of these FIGURES.

Bifurcations 32 and 33 on gate 28 is so dimensioned that they are just nicely received between side walls 15 and 15*a* of guide body 9. Bifurcations 38 and 39 of leaf spring 36 are spaced from each other such that they are just nicely received between bifurcations 32 and 33 of gate 28. Thus, when the gate 28 and leaf spring 36 are so assembled relative to the guide body 9, the transverse pair of perforations in the guide body main body portion 9*a* (one of which is shown at 16), the transverse perforation 27 in the lug-like portion 26 of the supplementary body portion 9*b* of guide body 9, perforations 34 and 35 in bifurcations 32 and 33 of gate 28 and perforations 40 and 41 in bifurcations 38 and 39 of leaf spring 36 can all be arranged coaxially so as to receive a pin 58 therethrough (see FIG. 4). The pin 58 not only serves to affix the gate 28 and leaf spring 36 to the guide body 9, but also permits the gate 28 and leaf spring 36 to pivot thereabout. The pin 58 may take any appropriate form including a roll pin, a solid pin or the like. FIGS. 3 and 5 illustrate the gate 28 and leaf spring 36 pivotally affixed to the guide body 9 by pin 58.

The main body portion 9*a* of guide body 9 is provided with a pair of slots 59 and 60. The slots 59 and 60 are substantially identical. The slot 59 extends through the main body portion 9*a* intersecting the transverse perforation 17. Similarly, the slot 60 extends through the main body portion 9*a*, intersecting the transverse perforation 18. The slots 59 and 60 are adapted to respectively receive the hook-shaped free ends 50 and 51 of legs 48 and 49 of latch lever 46, as shown in FIGS. 3 and 5. The hook-shaped portions 50 and 51 of legs 48 and 49 are located in slots 59 and 60 such that perforations 52 and 53 are coaxial with the transverse perforations 17 and 18 in the main body portion 9a of the guide body 9. Pins 61 and 62 (see FIG. 4) are used to pivotally affix portions 50 and 51 within the guide body slots 59 and 60. Thus, pin 61 extends through the transverse guide body perforation 17 and perforation 52 of latch lever 46. Similarly, the pin 62 extends through the transverse guide body perforation 18 and perforation 53 of latch lever 46. Latch lever 46 is illustrated as being pivotally affixed to the guide body 9 in FIGS. 3 and 5.

Figure 6:
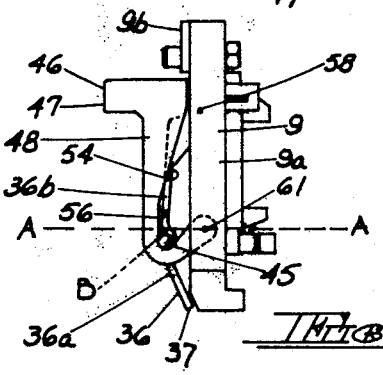
FIG. 6 is a side elevational view of the guide body illustrating the gate and the latch assembly in their closed and latched positions.

The invention having been described in detail, its operation can be set forth as follows: Reference is made to FIG. 3 illustrating the latch assembly in its closed and locked position and to FIG. 5 illustrating the latch assembly (and the gate) in their open positions. Reference is also made to FIGS. 6 through 9 which illustrate the sequence of steps in the operation of the latch assembly of the present invention. FIGS. 3 and 6 illustrate the gate in its closed position and the latch assembly in its gate-locking position. The locking position of the latch assembly will be discussed in detail hereinafter. Suffice it to say at this point that when the latch lever 46 is in its locking position as shown in FIGS. 3 and 6, its cam surfaces 56 and 57 engage the free ends of latch pin 45. This causes the latch pin 45 to be shifted slightly toward gate 28. This, in turn, results in compression of leaf spring 36 toward the gate. The free end 37 of the leaf spring engages the lower front surface 30 of the gate holding it firmly in its closed position.

To open the front gate 28, it is only necessary that the operator grasp the handle portion 47 of latch lever 46 and pull it outwardly and downwardly. This will result in a counter-clockwise rotation of the latch lever 46, as viewed in the FIGURES. During the opening procedure, once latch pin 45 has passed over-center with respect to latch lever cam surfaces 56 and 57 (as will be discussed hereinafter) no further force is required by the operator and the latch lever 46 will readily shift to its fully open position illustrated in FIGS. 5 and 7. It will be noted from these Figures that the open position of latch lever 46 is determined by the abutment of legs 48 and 49 against the inside lower surface of the slots 59 and 60 in the main body portion 9a of guide body 9.

Figure 8:
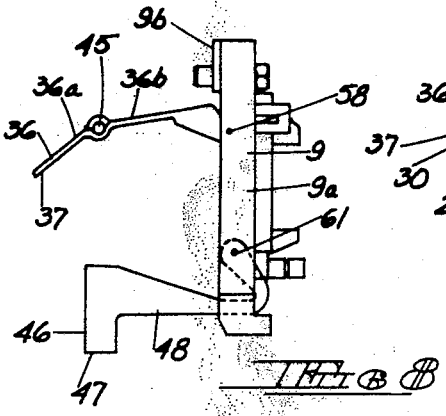
Figure 9:
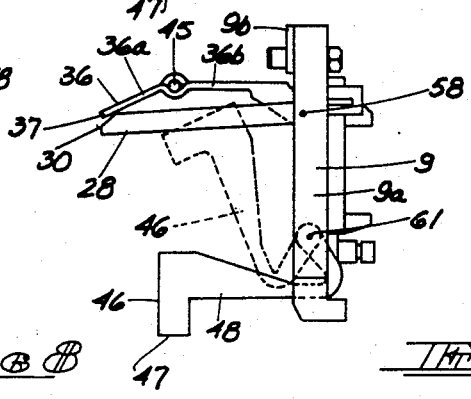

With the latch lever 46 in its open position, the leaf spring 36 can be raised to its open position as shown in FIG. 8, followed by the opening of the gate 28, as shown in FIG. 9. At the point, the drive track 12 is open and a jammed or broken staple can be readily removed. With the leaf spring 36 and the gate 28 in their open positions, the latch lever 46 can be rotated (clockwise as viewed in the Figures) toward its closed position until the handle portion 47 thereof abuts the inside surface of gate 28. In this way, the latch lever 46 can be used to hold the leaf spring 36 and gate 38 in their open positions. Latch lever 46 is shown in its supporting position in broken lines in FIG. 9.

Figure 7:
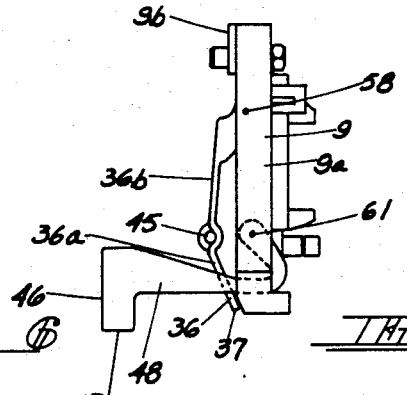
FIGS. 7, 8 and 9 are side elevational views, similar to FIG. 6, and illustrating the sequence of steps involved in unlatching and opening the latch assembly and gate.

To close and latch the gate, it is first necessary to lower the latch lever 46 to its fully opened position as shown in solid lines in FIG. 9. Thereafter, the gate 28 is free to shift to its closed position as shown in FIG. 8, as is the leaf spring 36, as shown in FIG. 7. At this point, it is only necessary for the operator to rotate the handle (in a clockwise direction as viewed in the Figures) to its closed position (as shown in FIGS. 3 and 6).

If, for any reason, the gate 28 and/or the leaf spring 36 are not in their full downwardly depending positions shown in FIG. 7, when the latch lever 46 is rotated toward its closed position, the free ends of latch pin 45 will first engage the first cam surfaces 54 and 55 of latch lever legs 48 and 49. These first cam surfaces 54 and 55 serve simply as lead-in surfaces, guiding the latch pin 45 to the second cam surfaces 56 and 57 of latch lever legs 48 and 49. On the other hand, if the gate 28 and the leaf spring 36 are in their full downwardly depending position as shown in FIG. 7, as the latch handle is rotated toward its closed position the latch pin 45 will first engage the latch lever second cam surfaces 56 and 57 near the junction of these cam surfaces and cam surfaces 54 and 55.

Further rotation of the latch lever 46 toward its closed position will cause the free ends of latch pin 45 to shift along latch lever second cam surfaces 56 and 57. As the ends of latch pin 42 travel along the latch lever cam surfaces 56 and 57 the latch pin is cammed through a slight arc about pivot pin 58 toward the gate 28 and guide body 9. This results in the simultaneous compression of leaf spring 36 so that when the latch lever 46 is in its fully closed position, the free end 37 of leaf spring 36 is compressed against gate surface 30, maintaining the gate 28 firmly in closed position.

In FIG. 6 a dashed line A—A is shown, indicating an imaginary plane passing through pivot pins 61 and 62 which mount the latch lever legs 48 and 49 to the main body portion 9a of guide body 9. The plane A—A is perpendicular to the front surface of guide body 9. When the latch lever 46 is in its closed position as shown in FIG. 6, the plane A—A intersects latch lever leg second cam surface 56 at a point B shown in FIG. 6. It will be understood that the plane A—A intersects the latch lever second cam surface 57 at a similar point (not shown). In the final stages of the closing procedure, once the free ends of latch pin 45 have passed point B on second cam surface 56 and the similar point (not shown) on second cam surface 57, the ends of latch pin 45 have passed through dead center and have achieved the desired over-center position. Since the latch pin 45 has been shifted and the leaf spring 36 has been compressed, the ends of latch pin 45 will exert a force against the latch lever second cam surfaces 56 and 57, which force will tend to urge latch lever 46 to its fully closed position. As a result, once the ends of latch pin 45 have achieved their over-center position, the leaf spring 36 will indeed complete the closing. In similar fashion, at the time of a jam or the like, any pressure exerted on the gate 28 will be transmitted through the leaf spring 36 and the ends of latch pin 45 to the latch lever 46, urging the latch lever to remain in its closed position.

During the opening procedure, once the operator has shifted latch lever 46 toward its open position by an amount sufficient to cause the ends of latch pin 45 to pass point B and the similar point (not shown) on latch lever second cam surfaces 56 and 57, latch lever 46 can thereafter be freely swung to its open position and the leaf spring 36 and gate 28 can be shifted to their open positions.

Modifications may be made in the invention without departing from the spirit of it.

What is claimed is:

1. In a fastener driving tool of the type having a fastener-containing magazine, a reciprocating fastener driver, a guide body communicating with said magazine and having a front opening with a front gate closing said front opening, said gate having a first free end and a second end pivotally affixed to said guide body, said gate being swingable between an open position and a closed position wherein said gate and guide body define a portion of a drive track for said fastener driver and said fasteners, and a latch assembly to lock said gate in said closed position, the improvement comprising said latch assembly including a leaf spring, a latch pin and a latch lever, said leaf spring overlying said gate and having a first free end and a second end pivotally affixed to said guide body adjacent said second end of said gate, said leaf spring having a substantially planar first portion terminating in said first free end and a substantially planar second portion terminating in said second end, said first and second portions being angularly related so as to bow outwardly of said gate away from said guide body, said latch pin being mounted transversely on said leaf spring at the juncture of said first and second portions thereof, said latch pin having free ends extending beyond each side of sid leaf spring and said gate, said latch lever being U-shaped and having a base portion configured to be manually grasped and terminating in a pair of parallel spaced substantially identical legs, said legs terminating in free ends pivotally affixed to said guide body to each side of said leaf spring and said gate, said latch lever being manually pivotable between an open position and a closed position wherein said legs engage said latch pins ends compressing said leaf spring against said gate locking said gate in closed position.

2. The latch assembly claimed in claim 1 wherein said gate has a pair of bifurcations at said second end thereof with coaxial transverse perforations formed therein, said leaf spring having a pair of bifurcations at said second end thereof with coaxial transverse perforations therein, said leaf spring bifurcations being so spaced as to be just nicely received between said gate bifurcations, a pivot pin passing through said bifurcation perforations of said gate and said leaf spring and through coaxial perforations in said guide body to pivotally mount said gate and said leaf spring to said guide body.

3. The latch assembly claimed in claim 1 wherein said leaf spring is substantially coextensive with said gate, said free end of said gate being relieved to approximate the angularity of said first leaf spring portion, said free end of said first leaf spring portion bearing against said relieved first end of said gate to lock said gate in said closed position when said latch lever is in said closed position.

4. The latch assembly claimed in claim 1 wherein said leaf spring has three aligned depressions extending along said juncture of said first and second leaf spring portions, the central one of said depressions bowing away from said gate, the remaining two depressions bowing toward said gate, said depressions being so dimensioned as to receive said latch pin with a friction fit.

5. The latch assembly claimed in claim 1 wherein the free ends of said latch lever legs are hook-shaped and are pivotally affixed to said guide body in slots formed therein, each of said latch lever legs having a cam surface thereon to engage and urge its respective one of said free ends of said latch pin toward said gate with an over-center action to compress said leaf spring against said gate locking said gate when said latch lever is shifted from its open position to its closed position.

6. The latch assembly claimed in claim 2 wherein the free ends of said latch lever legs are hook-shaped and are pivotally affixed to said guide body in slots formed therein, each of said latch lever legs having a cam surface thereon to engage and urge its respective one of said free ends of said latch pin toward said gate with an over-center action to compress said leaf spring against said gate locking said gate when said latch lever is shifted from its open position to its closed position.

7. The latch assembly claimed in claim 6 wherein said leaf spring is substantially coextensive with said gate, said free end of said gate being relieved to approximate the angularity of said first leaf spring portion, said free end of said first leaf spring portion bearing against said relieved first end of said gate to lock said gate in said closed position when said latch lever is in said closed position.

8. The latch assembly claimed in claim 7 wherein said leaf spring has three aligned depressions extending along said juncture of said first and second leaf spring portions, the central one of said depressions bowing away from said gate, the remaining two depressions bowing toward said gate, said depressions being so dimensioned as to receive said latch pin with a friction fit.

* * * * *